US006022144A

United States Patent [19]

Hausslein

[11] Patent Number: 6,022,144

[45] Date of Patent: Feb. 8, 2000

[54] CLOSURE SYSTEM FOR PLIABLE CONTAINER AND METHOD AND APPARATUS FOR PRODUCING SAME

[75] Inventor: Robert W. Hausslein, Lexington, Mass.

[73] Assignee: Arthur D. Little Enterprises, Inc., Cambridge, Mass.

[21] Appl. No.: 08/885,667

[22] Filed: Jun. 30, 1997

[51] Int. Cl.[7] ..... B65D 33/24; B65D 33/30

[52] U.S. Cl. ..... 383/33; 383/89; 383/43; 493/214

[58] Field of Search ..... 363/33, 84, 85, 363/88, 89, 43, 120, 104; 493/213, 214

[56] References Cited

U.S. PATENT DOCUMENTS

| | | | |
|---|---|---|---|
| 670,029 | 3/1901 | Meier . | |
| 1,124,091 | 1/1915 | Willoughby . | |
| 1,138,882 | 5/1915 | Meier . | |
| 1,265,996 | 5/1918 | Cerny . | |
| 1,658,294 | 2/1928 | Lewis . | |
| 1,798,945 | 3/1931 | Lamarthe . | |
| 1,982,845 | 12/1934 | Wagman . | |
| 2,000,928 | 5/1935 | Cundall . | |
| 2,037,110 | 4/1936 | Bischoff . | |
| 2,040,271 | 5/1936 | Rosenweig . | |
| 2,067,367 | 1/1937 | Willetts et al. . | |
| 2,074,843 | 3/1937 | Hiering . | |
| 2,084,757 | 6/1937 | Alter . | |
| 2,093,976 | 9/1937 | Farmer . | |
| 2,125,354 | 8/1938 | Meier . | |
| 2,142,904 | 1/1939 | Lamarthe . | |
| 2,150,627 | 3/1939 | Lieber . | |
| 2,158,955 | 5/1939 | Blacher . | |
| 2,227,390 | 12/1940 | Green . | |
| 2,232,888 | 2/1941 | Schimelmitz . | |
| 2,409,621 | 10/1946 | Geimer et al. | 493/214 X |
| 2,564,570 | 8/1951 | Hatfield . | |
| 2,572,686 | 10/1951 | Andre . | |
| 2,804,113 | 8/1957 | Nash . | |
| 2,822,012 | 2/1958 | Gold . | |
| 2,922,568 | 1/1960 | Harker | 383/89 X |
| 2,973,131 | 2/1961 | Mead et al. . . 9/1964 Olsson | 383/43 X |

(List continued on next page.)

FOREIGN PATENT DOCUMENTS

| | | | |
|---|---|---|---|
| 201257 | 11/1986 | European Pat. Off. | 383/203 |
| 2304670 | 9/1973 | Germany . | |
| 111005 | 11/1934 | Hungary . | |

OTHER PUBLICATIONS

"Horizontal Pouch Machines", VOLPAK Packaging Machines.

"Variable Cycle", EM20; MK 1000C.

*Primary Examiner*—Stephen P. Garbe

[57] ABSTRACT

A closure system for use in repetitively opening and closing an openable end of a pliable container includes first and second shape memory elements that are adapted to be attached to side walls of the pliable container adjacent the openable end thereof. Each of the first and second shape memory elements includes an elongated, generally concave surface portion and an opposing, generally convex surface portion. In accordance with various embodiments of the invention, the shape memory elements are provided on the container with the concave surface portions facing each other when the pliable container is in an open condition to maintain the opposing side walls in a spaced relationship in order to permit enhanced access to an interior of the container. In each embodiment, when the openable end is closed, the generally concave surface portion of one of the shape memory elements assumes a nested position with the generally convex surface portion of the other shape memory element in order to maintain the side walls in a close bearing relationship at the openable end. The shape memory elements can be constituted by various bowed members, including plastic bands, metal strips and wires which can either be fixedly or rotatably mounted to the bag. The closure system has application to various types of pliable containers, including two-sided, multi-ply and gusseted bags. A method and apparatus for producing pliable containers incorporating the closure system of the invention is also provided.

44 Claims, 7 Drawing Sheets

U.S. PATENT DOCUMENTS

| | | | |
|---|---|---|---|
| 3,066,846 | 12/1962 | Domigan | 383/89 X |
| 3,149,772 | | | |
| 3,201,030 | 8/1965 | Pollack . | |
| 3,259,302 | 7/1966 | Rocchisani | 383/89 X |
| 3,272,248 | 9/1966 | O'Farrell . | |
| 3,366,312 | 1/1968 | Lowenberg et al. | 383/33 |
| 3,406,853 | 10/1968 | McLeod | 383/33 X |
| 3,442,437 | 5/1969 | Mann | 383/88 X |
| 3,446,420 | 5/1969 | Rinecker | 383/89 |
| 3,782,601 | 1/1974 | Krawagna . | |
| 4,276,982 | 7/1981 | Sibrava et al. | 493/214 X |
| 4,317,478 | 3/1982 | Babbidge . | |
| 4,593,408 | 6/1986 | Drobish et al. | 383/43 |
| 4,898,477 | 2/1990 | Cox et al. . | |
| 4,997,104 | 3/1991 | Pohl | 493/213 X |
| 5,000,500 | 3/1991 | Almog . | |
| 5,002,245 | 3/1991 | Hansen et al. . | |
| 5,037,138 | 8/1991 | McClintock | 383/43 X |
| 5,044,774 | 9/1991 | Bullard et al. . | |
| 5,094,707 | 3/1992 | Bruno . | |
| 5,181,365 | 1/1993 | Garvey et al. . | |
| 5,184,896 | 2/1993 | Hammond et al. . | |
| 5,337,539 | 8/1994 | Barton . | |
| 5,372,428 | 12/1994 | Bruno et al. . | |
| 5,377,474 | 1/1995 | Kovacs et al. . | |
| 5,383,989 | 1/1995 | McMahon . | |
| 5,524,990 | 6/1996 | Buck . | |
| 5,557,907 | 9/1996 | Malin et al. . | |
| 5,570,569 | 11/1996 | Masuda . | |

CLOSURE SYSTEM FOR PLIABLE CONTAINER AND METHOD AND APPARATUS FOR PRODUCING SAME

BACKGROUND OF THE INVENTION

1. Field of the Invention

The present invention pertains to the art of packaging and, more specifically, to a system for repetitively opening and sealingly closing an openable end of a pliable container, such as a bag, as well as a method and apparatus for producing a pliable container with a closure system.

2. Discussion of the Prior Art

Pliable or flaccid containers are widely used to store both edible and non-edible products. For example, snack items, such as various types of chips and cereals, are typically packaged in pliable containers. These containers are generally sealed at both ends for initial packaging purposes and then one of the ends is opened to access the product. It is often desirable to utilize the container to store the product for extended periods of time and to repetitively open and close one end of the container to selectively access the contents thereof.

When used to store edible food items, it is particularly advantageous to adequately seal the openable end of the container between uses in order to prolong the useful life of the food items stored therein. For this reason, once the initial seal at one end of the container is broken, it is common practice to roll up the openable end of the pliable container for storage. Unfortunately, the rolled-up ends of such pliable containers generally tend to unroll between uses, which leads to the food items becoming stale prematurely.

Proposed solutions to this problem include providing various types of closure structures at the openable end to maintain the side walls of the container in a close bearing relationship for sealing purposes. For example, it is known to utilize a clip to prevent the openable container end from unrolling. Since such clips are completely separate from the container, they can be misplaced and are therefore often only used when readily available. In addition, these clips often tend to break and only directly maintain a small central section of the openable container end in a rather tight, closed condition. Zip-type closure arrangements have also become quite prevalent for use with certain types of bags. Such closure arrangements are considered advantageous in at least they generally extend entirely across the width of the openable end and are formed integral with the container. However, such closure arrangements are considered to be quite difficult to use, particularly for children and the elderly, due to the required dexterity. In addition, these closure arrangements do not provide an immediate indication that a complete seal has been established. Instead, the entire arrangement must be systematically sealed from one end of the opening to the other and if any portion is not sealed, the purpose of the entire closure can be completely compromised.

In addition to the need for providing a closure system for sealing closing an openable end of a pliable container, it is also considered advantageous to enhance the accessibility to an interior of a container when the container is opened. More specifically, when the container is opened, it is desirable to maintain the side walls of the container spaced apart, at least at the open end of the container, to permit easy access to the contents. Of course, neither clips nor zip-type closure systems perform this desired function.

Other types of closure arrangements for pliable containers have been proposed to perform both of these desired functions, such as that represented in U.S. Pat. No. 5,037,138. According to this patented arrangement, a snap-type closure mechanism includes a closure strip secured to one side wall of a pliable container, adjacent an openable end thereof. The closure mechanism is generally biased to a closed condition, but can be flexed outward along a centerline of the strip to maintain the container in an open condition. Merely squeezing the closure strip near the centerline causes the container to assume the closed condition.

The problem with such an arrangement is that it really only maintains a central portion of the container open an adequate amount, particularly since any biasing force tending to hold the container open essentially acts between side edge portions of the container and the closure strip. No closure structure is provided along the other side wall of the container to co-act with the closure strip, such that the degree to which the container can be held open is limited and the sealing effectiveness of the closure is minimized.

Based on the above, there exists a need in the art for a simple, inexpensive closure system for use with pliable containers which will enhance the accessibility to the contents when the containers are open and which can be effectively used to repetitively seal the containers.

SUMMARY OF THE INVENTION

The present invention is directed to a closure system for use in repetitively opening and closing an openable end of a pliable container. In accordance with various preferred embodiments of the invention, the closure system includes first and second shape memory elements that are adapted to be attached to respective opposing side walls of the pliable container adjacent the openable end thereof. Each of the first and second shape memory elements includes an elongated, generally concave surface portion and an opposing, generally convex surface portion. In various embodiments of the invention, the shape memory elements are provided on the container with the concave surface portions facing each other when the pliable container is in an open condition to maintain the opposing side walls in a spaced relationship in order to permit enhanced access to an interior of the container. In each of the embodiments, when the openable end is closed, the generally concave surface portion of one of the shape memory elements assumes a position substantially overlying the generally convex surface portion of the other shape memory element in order to maintain the container side walls in a close bearing relationship at the openable end.

The first and second shape memory elements can take various forms in accordance with the invention, including arcuate, flexible bands formed of plastic or metal, curved wires or other bowed, spring-like elements. In many of the preferred embodiments of the invention, the first and second shape member elements constitute similarly constructed shape memory elements which are bowed to define the opposing concave and convexed surface portions. Both of the shape memory elements are attached chordwise to an upper end portion of the container with the shape memory elements being arranged in vertically spaced planes when the container assumes an open condition. Upon flexing of the shape memory elements toward one another during closing of the container, each of the shape memory elements will tend to flatten out to some extent against the inherent spring-like characteristics thereof until the two side walls of the pliable container come close together. At this point, the upper shape memory element will be caused to automatically fold over such that it drops down into the plane of the lower shape memory element and substantially overlies the concave surface portion of the lower shape memory element. Once in this position, both of the shape memory elements will be permitted to flex in the same direction thereby assuming an arcuate sealing condition. When applied to containers formed with rather flimsy side walls, the openable end of the container can be reinforced, adjacent the first and second shape memory elements, by auxiliary support members which, preferably, do not possess the inherent spring characteristics of the first and second shape memory elements.

In certain embodiments of the invention, at least one of the shape memory elements is constituted by a wire which is bowed in a relaxed state such that the wire defines opposing concave and convex surface portions. The wire can be sandwiched between two film layers, formed from plastic, paper, cloth or the like, positioned between adjacent layers of a multi-ply container side wall or otherwise attached adjacent the openable end of the container. When used in combination with another shape memory element, the wire shape memory element will also flex outwardly to provide enhanced access to the interior of the pliable container and can be caused to conform to the shape of the other shape memory element upon closing the openable end of the container by either folding over in the manner described above or rotating about its arcuate longitudinal axis. With the shape memory elements extending across the width of the bag, the entire side walls of the container are maintained in a close bearing relationship at the openable end when in the closed condition.

In accordance with further preferred embodiments of the invention, the two shape memory elements can be attached to the opposing side walls adjacent the openable end of the container in identical planes. In still further embodiments, vertically spaced shape memory elements can be placed on the same side of a container. In such an arrangement, folding over of the openable end of the container will cause the shape memory elements to overlie one another or nest in a manner analogous to other mentioned embodiments of the invention. Of course, this arrangement will not bias the container into an open condition when access to the interior thereof is desired.

Therefore, in general, the invention is directed to a closure system for use in repeatedly opening and sealingly closing an openable end of a pliable container by providing first and second shape memory elements, each of which includes an elongated generally concave surface portion and an opposing, generally convex surface portion, along respective side walls of the pliable container adjacent the openable end. With this arrangement, the pliable container can be selectively closed to seal the contents thereof by simply mating the first and second shape memory elements. Additional features and advantages of the present invention will become more readily apparent from the following detailed description of the preferred embodiments thereof when taken in conjunction with the drawings wherein like reference numerals refer to corresponding parts in several views.

DETAILED DESCRIPTION OF THE PREFERRED EMBODIMENTS

Figure 1:
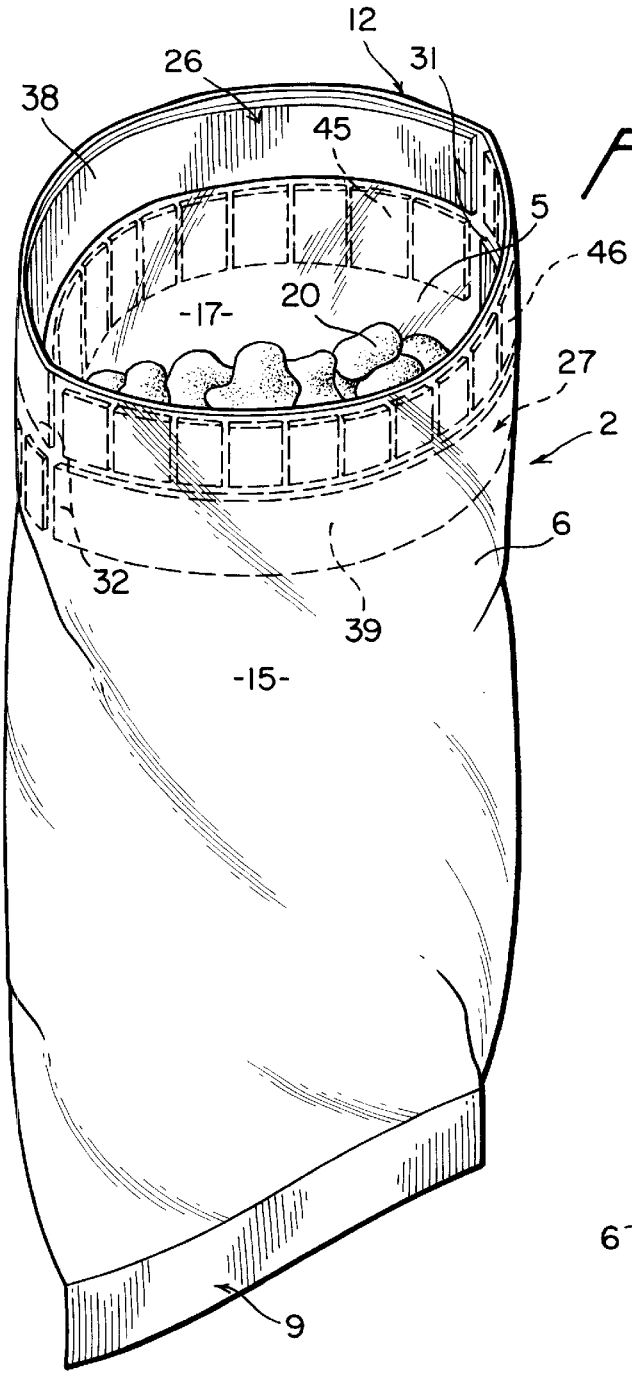
FIG. 1 is a perspective view of a pliable container having an open end incorporating a closure system constructed in accordance with a first preferred embodiment of the present invention.

With initial reference to the embodiment of FIG. 1, a closure system constructed in accordance with the present invention is particularly adapted for use with a pliable container which is indicated at 2. In the embodiment shown, pliable container 2 constitutes a bag generally of the type known for use in packaging food items such as potato chips and cereals. Therefore, pliable container 2 includes opposing side walls 5 and 6, which are generally formed from wrapping a single piece of material, typically referred to as a web, along a longitudinal seam line (not shown). Pliable container 2 includes a closed end 9 and an openable end 12. The material for pliable container 2 is generally constituted by paper or plastic, but can take other forms including foils, laminated structures, leather, cloth and the like. On a typical chip or cereal bag, closed end 9 would be formed from heat sealing side walls 5 and 6. Of course, openable end 12 would be originally provided with a commensurate heat sealed portion which has been cut off to arrive at the arrangement shown in FIG. 1 but which typically would extend above openable end 12 as depicted. Therefore, pliable container 2 includes an outer surface 15 and an inner surface 17 and the interior of pliable container 2 is filled with food items such as that indicated at 20.

In accordance with a first preferred embodiment of the closure system of the invention, first and second shape memory elements 26 and 27 are attached to the opposite side walls 5 and 6 respectively. In the embodiment shown, each of the shape memory elements 26 and 27 is constituted by an elongated band, preferably formed of plastic. Each of the shape memory elements 26 and 27 preferably extends across substantially the entire width of pliable container 2 such that ends 31 and 32 of each shape memory element 26 and 27 are adjacent side end portions (not labeled) of pliable container 2 where crease lines are typically formed. Each shape memory element 26 and 27 is bowed in a relaxed state so as to define a concave surface portion 38 and an opposing convex surface portion 39.

As clearly illustrated in FIG. 1, first shape memory element 26 is arranged vertically above second shape memory element 27. Although first and second shape memory elements 26 and 27 are secured to inner surface 17 of pliable container 2, it should be recognized that the first and second shape memory elements 26 and 27 could equally be attached to outer surface 15 of pliable container 2. In addition, the first and second shape memory elements 26 and 27 can be attached to pliable container 2 in various ways, including a stitching operation or through the use of other types of mechanical fasteners known in the art. When such other fastening arrangements are utilized, first and second shape memory elements 26 and 27 can be provided with slits, flaps and/or pockets (not shown) to enhance the securing thereof to pliable container 2. In addition, various types of adhesives, including pressure sensitive, heat activated and double-sided tape types, can be utilized. When applied during the formation of a typical pliable container for food items and the like, heat sealing the shape memory elements 26 and 27 would be preferred due to its ease of implementation and associated economical advantages. In any event, it should be understood that the shape memory elements employed in accordance with the present invention may be attached to a pliable container through the use of various fastening arrangements.

Again, it should be noted that, although first and second shape memory elements 26 and 27 are both illustrated to be attached to inner surface 17 of pliable container 2, the first and second shape memory elements 26 and 27 may be equally applied to the outer surface 15, or between layers of each side wall 5 and 6 if a multi-ply container is selected. In any event, first and second shape memory elements 26 and 27 are adapted to be secured to pliable container 2 adjacent openable end 12 with the generally concave surface portions 38 of each of the first and second shape memory elements 26 and 27 facing each other when pliable container 2 is in an open condition as illustrated in FIG. 1. Since first and second shape memory elements 26 and 27 are bowed so as to define the concave and convex surface portions 38 and 39, side walls 5 and 6 will be maintained in a spaced relationship to permit ready access to food items 20 within pliable container 2.

Figure 2:
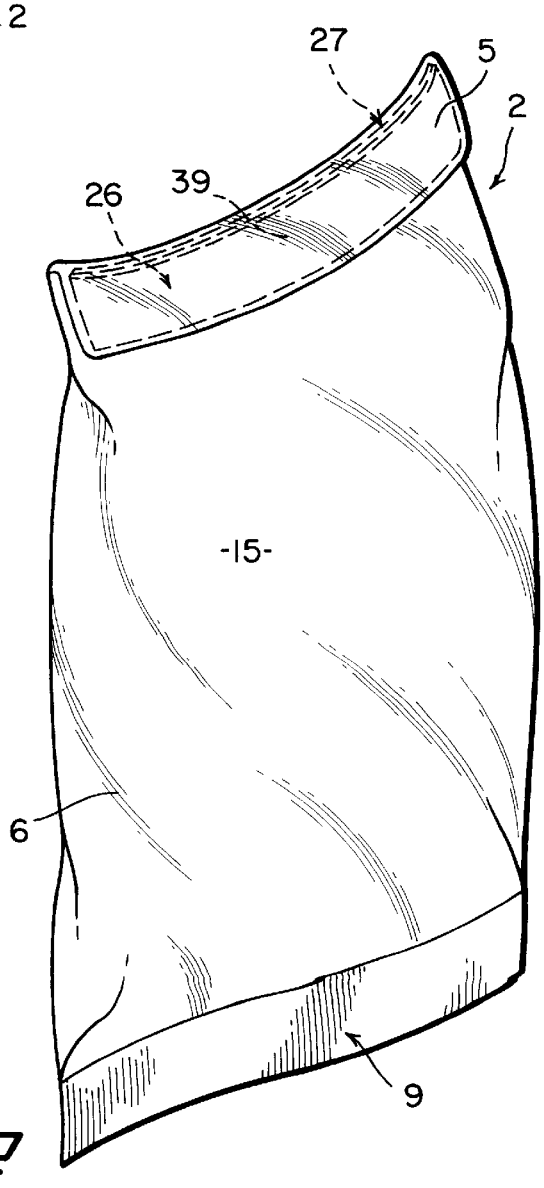
FIG. 2 is a perspective view of the pliable container of FIG. 1 in a closed condition.

When it is desired to sealingly close pliable container 2 for future access, side walls 5 and 6 are merely drawn closer together which causes first and second shape memory elements 26 and 27 to momentarily flatten. Of course, this flattening of first and second shape memory elements 26 and 27 is performed against the natural tendency of the shape memory elements 26 and 27 to assume the positions shown in FIG. 1. Therefore, first and second shape memory elements 26 and 27 essentially act as leaf springs. As the first and second shape memory elements 26 and 27 are brought closer together, first shape memory element 26 will inherently tend to fold over second shape memory element 27 such that the concave surface portion 38 of first shape memory element 26 overlies the convexed surface portion 39 of second shape memory element 27 as best presented in FIG. 2. Once first and second shape memory elements 26 and 27 are nested in this manner, they automatically assume their bowed shape, which is also imparted to side walls 5 and 6 of pliable container 2. In this condition, side walls 5 and 6 are maintained in a closed bearing relationship to assure adequate sealing of the contents within pliable container 2. Pliable container 2 can be selectively opened at end 12 by momentarily flattening first and second shape memory elements 26 and 27, unfolding first shape memory element 26 and then allowing both of the shape memory elements 26 and 27 to again assume the position shown in FIG. 1 wherein ready access to the interior of pliable container 2 is again provided.

Ideally the web used to make pliable container 2 should be somewhat stiff rather then totally limp in nature, but should pen-nit free hinging of the horizontal foldover crease created between first and second shape memory elements 26 and 27. The materials referenced above for pliable container 2 satisfy this criteria. Therefore, the closure system of the present invention can be advantageously and easily applied to existing food item packages of this type. The purpose of utilizing a rather stiff material for pliable container 2 is to assure that first and second shape memory elements 26 and 27 will be maintained in proper alignment. However, the closure system of the present invention can also be utilized with a pliable container formed of a rather thin, flimsy web, such as a typical polyethylene sandwich bag. In this case, reinforcing bands, such as those indicated at 45 and 46 with dotted lines in FIG. 1, are provided to stiffen or reinforce openable end 12. As shown in FIG. 1, such reinforcing bands 45 and 46 are provided below first shape memory element 26 and above second shape memory element 27 respectively. Actually, it has been found that band 45 substantially enhances the sealing of pliable container 2, particularly when provided with a substantial width and when extending transversely right out to the edges of pliable container 2, and band 46 provides marginal benefits. Unlike first and second shape memory elements 26 and 27, reinforcing bands 45 and 46 are passive in nature in that they readily flex to assume positions dictated by first and second shape memory elements 26 and 27. To assure that reinforcing bands 45 and 46 only provide this stiffening function, each of the reinforcing bands 45 and 46 can be provided with various spaced, vertical grooves 48 which act as hinges. In general, reinforcing bands 45 and 46 merely need to exhibit a high flexibility in order to permit the bands 45 and 46 to freely bow, while being vertically stiff to assure that foldover will occur only along the horizontal crease.

It has been found that, in providing reinforcing bands 45 and 46 when utilizing the closure system of the present invention on rather flimsy pliable containers, the openable end 12 of the pliable container is adequately stiffened to assure that first and second shape memory elements 26 and 27 act in the manner described above to permit the repetitive opening and closing of the pliable container. At this point, it should also be noted that reinforcing bands 45 and 46 can be formed of various materials and in other ways, such as by thickening the container web material at the openable end of the pliable container. In fact, the pliable container can be integrally formed with structure which constitutes the first and second shape memory elements 26 and 27 as well. This arrangement can be advantageously carried out if pliable container 2 is made of plastic materials wherein integral shape memory elements can be created by forming bowed, thickened wall portions at openable end 12. Therefore, the entire closure system of the present invention can be formed integral with a pliable container at the time of manufacturing thereof or first and second shape memory elements 26 and 27 can be separately formed and attached to pliable container 2 in the manner described above.

Figure 3:
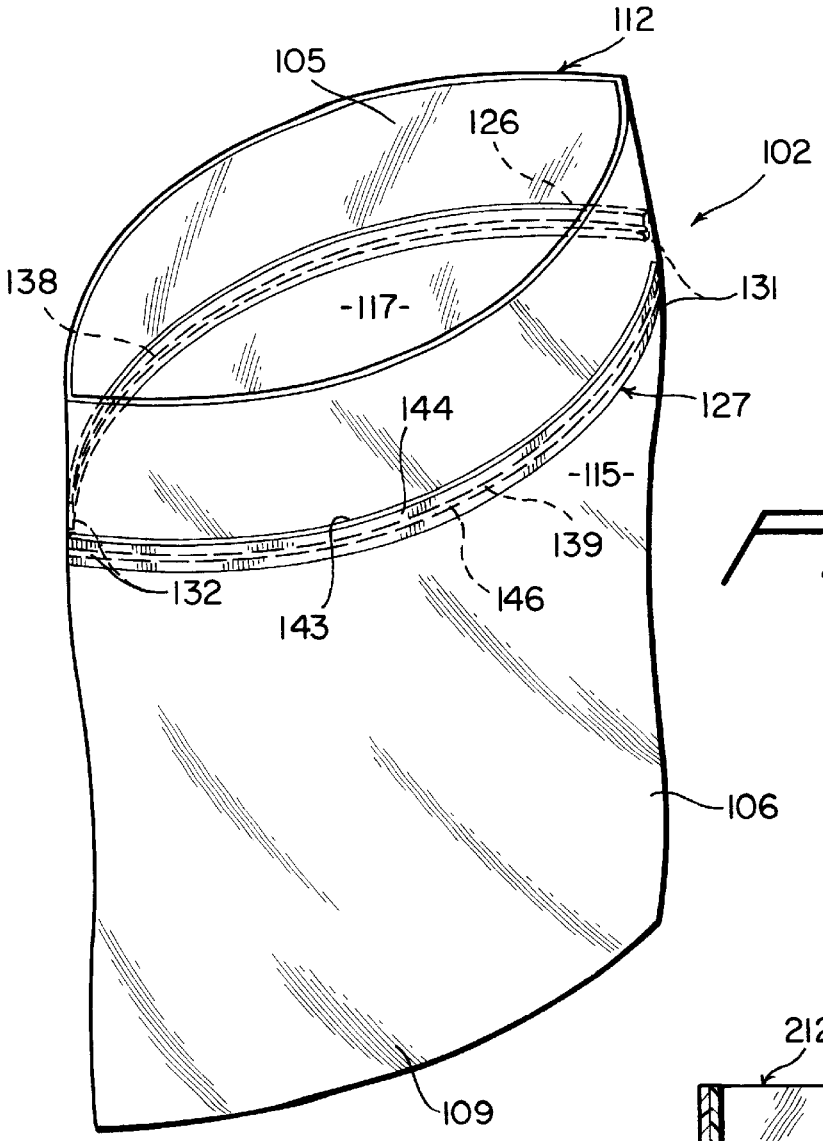
FIG. 3 is a perspective view of a pliable container incorporating a closure system constructed in accordance with a second embodiment of the invention.

As indicated above, first and second shape memory elements 26 and 27 generally act as springs and therefore can be made of any stiff, elastically deformable material including plastic, metal, wood, ceramics, laminated materials and the like without departing from the present invention. In the preferred embodiment described above, shape memory elements 26 and 27 are made of plastic, such as polystyrene, polyethylene terephthalate or polycarbonate. When utilizing metal for the shape memory elements, spring steel is preferably utilized. In the embodiment shown in FIG. 3, a pliable container 102, including side walls 105 and 106, is formed with a closed end 109 and an openable end 112. Pliable container 102 also includes an outer surface 115 and an inner surface 117 and has attached thereto a closure system defined by first and second shaped memory elements 126 and 127. As with the embodiment of FIGS. 1 and 2, each of the first and second shape memory elements 126 and 127 preferably extends across the entire width of pliable container 102 and has respective ends 131 and 132 that terminate adjacent side edges or creases (not separately labeled) of pliable container 102. Again, each shape memory element 126 and 127 includes a concave surface portion 138 and convex surface 139. In this embodiment, each of the first and second shape memory elements 126 and 127 is preferably formed with two material layers 143 and 144 between which is sandwiched a bowed wire 146. In this preferred embodiment, layers 143 and 144 are constituted by extruded plastic members, however, other laminating materials including paper and films could be readily utilized.

Therefore, in accordance with this embodiment, each of the first and second shape memory elements 126 and 127 take a form generally commensurate with typical bag ties, however, instead of utilizing a soft metal such as iron,, copper or aluminum for wire 146, a springy metal such as spring steel is utilized in the preferred embodiment to maintain the desired bowed configuration. Of course, other materials for wire 146 can be utilized so long as the desired concave and convex surface portions 138 and 139 are established and maintained. In the embodiment shown in FIG. 3, first and second shape memory elements 126 and 127 are illustrated as being adhesively secured to outer surface 115 of pliable container 102 with first shape memory element 126 located above second shape memory element 127 when pliable container 102 assumes the opened condition illustrated in this figure. As with the embodiments of FIGS. 1 and 2, squeezing pliable container 102 at openable end 112 to cause initial flattening of first and second shape memory elements 126 and 127 will result in first shape memory element 126 folding over second shape memory element 127 such that first and second shape memory elements 126 and 127 become nested with concave surface portion 138 of first shape memory element 126 overlying the convex surface portion 139 of second shape memory element 127 in the manner directly analogous to that described above with respect to the embodiment of FIGS. 1 and 2. The opening of pliable container 102 is performed in the manner directly commensurate with that described above as well.

Figure 4:
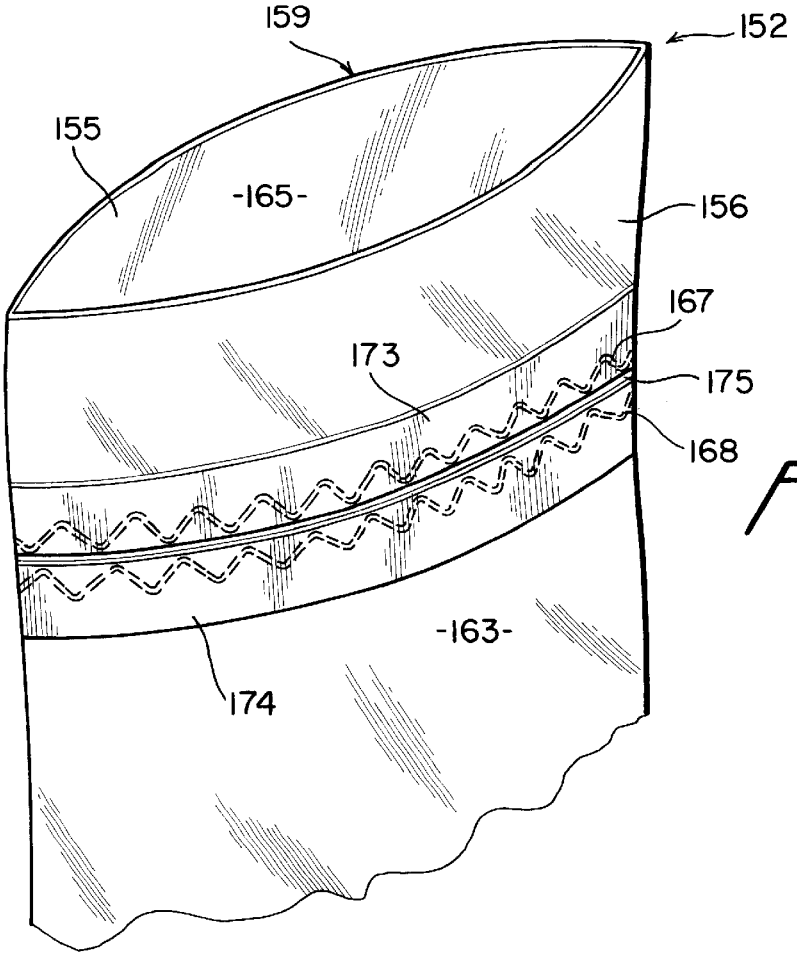
FIG. 4 is a partial perspective view of a pliable container incorporating a closure system constructed in accordance with a third embodiment of the invention.
Figure 5:
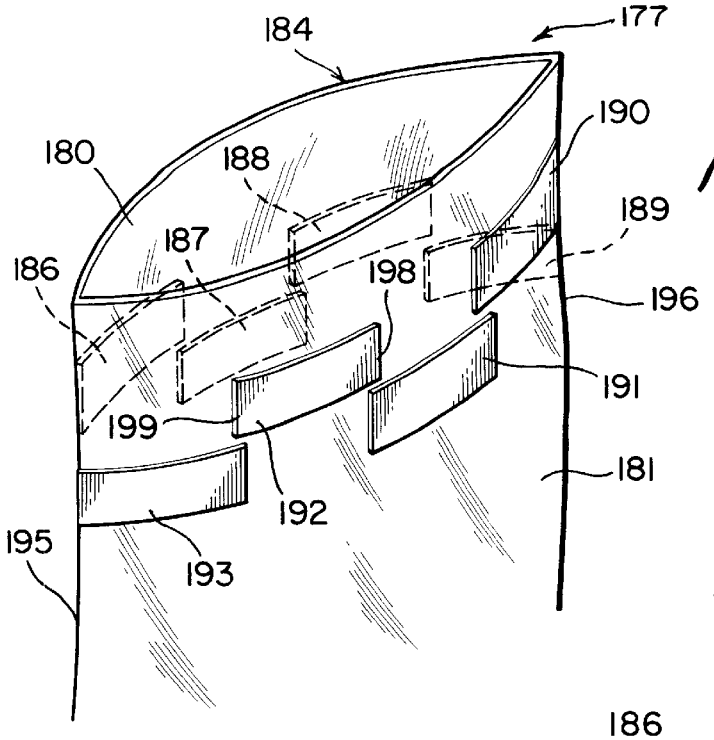
FIG. 5 is a partial perspective view of a pliable container incorporating a closure system constructed in accordance with a fourth embodiment of the invention, with the closure system shown in an open condition.
Figure 6:
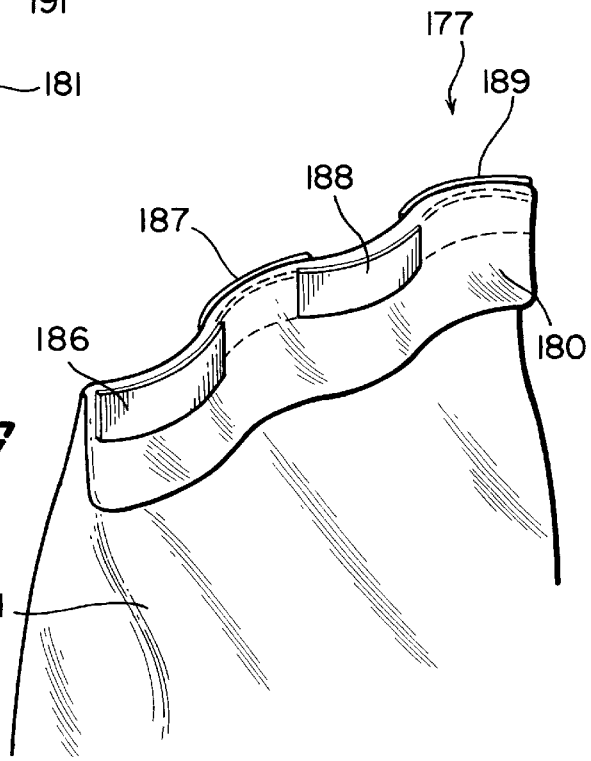
FIG. 6 is a partial perspective view of an upper portion of the pliable container shown in FIG. 5 in a closed condition.

FIGS. 4–6 represent additional embodiments of the present invention wherein sealing of a pliable container is performed by folding over one side wall of the container onto an opposing side wall such that shape memory elements applied to the container overlie one another. In this manner, these embodiments are generally analogous to those described above with respect to FIGS. 1–3. However, a few additional features of the present invention are exemplified in FIGS. 4–6 as will be detailed below with initial reference to FIG. 4.

In this embodiment, a pliable container 152 includes side walls 155 and 156 that define an openable end 159, as well as outer and inner surfaces 163 and 165. As shown, pliable container 152 has first and second shape memory elements 167 and 168 attached to outer surface 163 of side wall 156, with first shape memory element 167 being positioned above second shape memory element 168. Although shape memory elements 167 and 168 can take various forms in accordance with the present invention, including those described above with reference to FIGS. 1–3, first and second shape memory elements 167 and 168 are shown as bowed spring wires which are positioned between outer surface 163 and respective lamination layers 173 and 174. As illustrated, each spring wire generally zig-zags transversely across side wall 156. Although not separately labeled, as with the other embodiments described, each of the first and second shape memory elements 167 and 168 define opposing concave and convex surfaces.

With first and second shape memory elements 167 and 168 being mounted only on side wall 156, the end 159 of pliable container 152 is not held open to enhance the access to within pliable container 152 as in the embodiments described above. To enhance the opening, another shape memory element (not shown) would have to be positioned on side wall 155 directly opposite a second shape memory element 168. In any event, the inclusion of only first and second shape memory elements 167 and 168 still provides for an adequate seal for pliable container 152. In order to seal pliable container 152 in accordance with the invention, first and second shape memory elements 167 and 168 are vertically spaced by means of a transverse gap 175 which actually defines a fold line enabling the upper portion of pliable container 152 to be folded into the page as viewed in FIG. 4 so that first shape memory element 167 can nest with second shape memory element 168.

It should be recognized that the presentation of this embodiment exemplifies some additional aspects of the present invention. First of all, this embodiment illustrates that the shape memory elements can be provided on a single side of a pliable container if desired. The embodiment also illustrates another configuration that can be used for the shape memory elements. Furthermore, the embodiment illustrates how shape memory elements applied to a pliable container in accordance with the invention can be provided with varying degrees of bowing strength. For instance, in order for first shape memory element 167 to properly nest with second shape memory element 168 upon folding over of the upper portion of pliable container 152 into the page as shown in FIG. 4, the surface of first shape memory element 167 that is directed towards the interior of pliable container 152 assumes a convex shape in order to mate with the concave curvature of the inside of second shape memory element 168. However, when pliable container 152 is to be opened as shown in FIG. 4, first shape memory element 167 will actually work against second shape memory element 168 in that it tries to close openable end 159 of pliable container 152. This is overcome in accordance with the present invention since shape memory element 168 has a greater associated bending force than shape memory element 167. In other words, first shape memory element 167 is more passive than second shape memory element 168, thereby enabling pliable container 152 to assume the position shown in FIG. 4, while also enabling the bending forces associated with both of the spring wires to combine when pliable container 152 is closed to assure a proper seal.

Of course, it should be realized that the closure system of this embodiment can also function with second shape memory element 168 being more passive than first shape memory element 167. In addition, the shape memory elements 167 and 168 could take various forms in accordance with this embodiment, including plastic bands, laminated wires, etc. and the upper shape memory element could simple be indirectly attached to the pliable container 152 through the lower shape memory element. In such an arrangement, when pliable container 152 is open, the first shape memory element 167 would directly overlie the second shape memory element 168 and, when pliable container 152 is to be sealed closed, first shape memory element 167 would be flipped over so as to nest with second shape memory element 168 with various layers of pliable container 152 therebetween.

FIGS. 5 and 6 illustrate another embodiment wherein shape memory elements are again utilized to effect a seal through a fold-over operation. More specifically, FIG. 5 illustrates a pliable container 177 having opposing side walls 180 and 181 and an open end 184. This embodiment is considered generally analogous to that of FIGS. 1 and 2, however, each side wall 180 and 181 is provided with multiple shape memory elements. In the embodiment shown, side wall 180 is provided with shape memory elements 186–189 and side wall 181 is provided with shape memory elements 190–193. As clearly shown in this figure, shape memory elements 186–193 alternate between upper positions and lower positions about side walls 180 and 181. In addition, shape memory elements 186, 188, 190 and 192 are spaced slightly above shape memory elements 187, 189, 191 and 193 in order to define potential fold lines between these shape memory elements.

When side walls 180 and 181 are drawn together, side walls 180 and 181 will be caused to automatically fold over along the fold lines defined between the upper and lower shape memory elements and will assume the position shown in FIG. 6. Of course, in accordance with the other embodiments of this invention, each of the shape memory elements 186–193 defines respective concave and convex surfaces which become nested when pliable container 177 assumes the position shown in FIG. 6. Since multiple shape memory elements 186–193 are provided, a generally wavy sealing configuration is established when pliable container 177 is sealed as clearly shown in FIG. 6.

In order to enhance the sealing characteristics of pliable container 177, it is preferable to have shape memory elements 186 and 193 extend to and be secured directly adjacent side edge 195 and for shape memory elements 189 and 190 to extend and be secured directly adjacent to side edge 196. In addition, to avoid any vertical creases being developed, it should be noted that the shape memory elements 186–189 partially overlap in the vertical direction on side wall 180 and shape memory elements 190–193 vertically overlap along side wall 181. For example, shape memory element 192 has an associated transverse length which is greater than the lateral distance between shape memory elements 191 and 193 such that end portions 198 and 199 of shape memory element 192 are arranged directly above terminal ends (not labeled) of shape memory elements 191 and 193 respectively. It should also be noted that a similar wave-like closing condition could be achieved with alternating convex and concave shaped memory elements at the same level on a given side of the pliable container so long as the convex shape memory elements exhibit greater bending forces to hold the bag open since the intermediate, concave shape memory elements would always tend to close the container.

Figure 7:
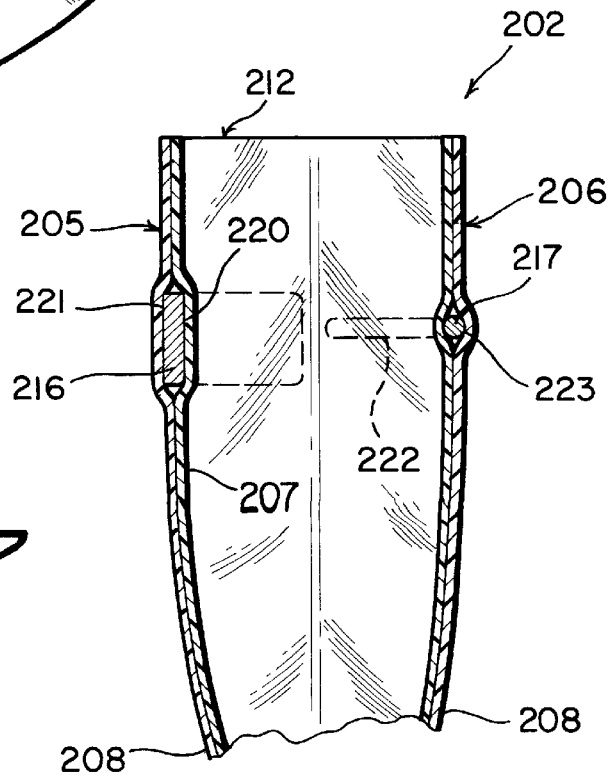
FIG. 7 is a cross-sectional view of a multi-ply container incorporating a closure system constructed in accordance with a fifth preferred embodiment of the invention.

FIG. 7 depicts a still further preferred embodiment of the invention wherein the closure system is applied to a pliable container 202 having side walls 205 and 206, each of which is formed with inner and outer layers 207 and 208. Between inner and outer layers 207 and 208 of side wall 205, adjacent an openable end 212 of pliable container 202 is a first shape memory element 216. In the embodiment shown, first shape memory element 216 constitutes a flexible plastic band constructed identical to that illustrated in FIG. 1 with respect to either of first or second shape memory elements 26 and 27. Of course, it should be readily understood that first shape memory element 216 can take various forms in accordance with this embodiment, and therefore can be constructed in a manner commensurate to shape memory elements 126, 127, 167 or 168 as well. This embodiment of the closure system of the present invention also incorporates a second shape memory element 217 that preferably takes the form of a bowed wire having a circular cross-section. This embodiment differs from the embodiments of FIGS. 1–6 in mainly three respects. First of all, second shape memory element 217 is located at a generally commensurate level with first shape memory element 216. Second, in a manner similar to shape memory element 216, second shape memory element 217 is positioned between the inner and outer layers 207 and 208 of side wall 206. Finally, second shape memory element 217 is freely rotatably mounted between inner and outer layers 207 and 208. Of course, first shape memory element 216 still includes analogous concave and convex surface portions 220 and 221 and second shape memory element 217 also includes concave and convex surface portions 222 and 223 respectively.

In this embodiment, when pliable container 202 is open, the concave surface portions 220 and 222 of first and second shape memory elements 216 and 217 face one another. However,, when first and second shape memory elements 216 and 217 are drawn together to place pliable container 202 in a closed condition, second shape memory element 217 will be caused to automatically rotate about its own axis, i.e., an arcuate longitudinal axis, such that the arrangement of concave and convex surface portions 222 and 223 will become reversed and convex surface portion 223 can assume a position nested with concave surface portion 220 of first shape memory element 216. Upon opening of pliable container 202, which is performed by simply spreading side walls 205 and 206, second shape memory element 217 will again rotate about its own axis to re-assume the position shown in FIG. 7 wherein openable end 212 is expanded to provide enhanced access to the interior of pliable container 202.

Figure 8:
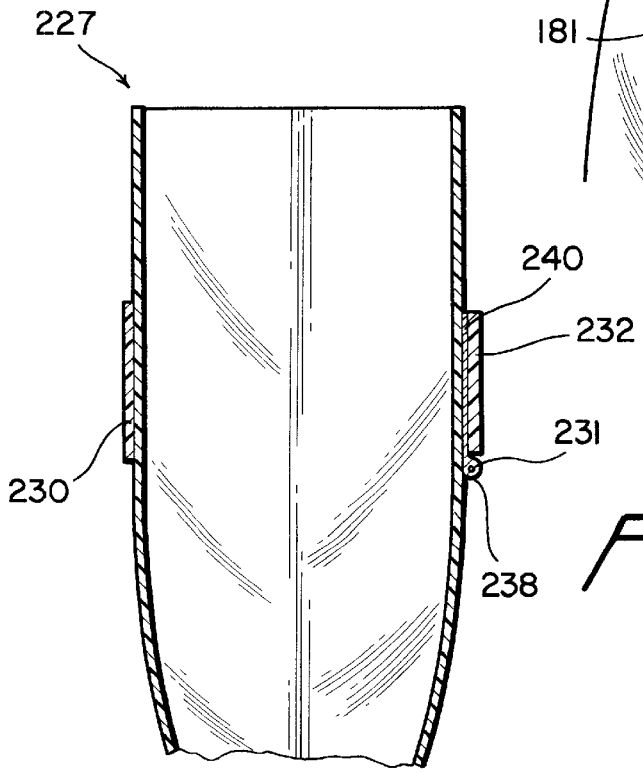
FIG. 8 is a cross-sectional view of a pliable container incorporating a closure system constructed in accordance with a sixth embodiment of the invention.

FIG. 8 illustrates a further embodiment of the invention that utilizes a rotatable wire as a shape memory element. More specifically, FIG. 8 illustrates a pliable container 227 having attached along one transverse side thereof a first shape memory element 230, depicted to constitute a band having an outer convex surface and an inner concave surface analogous to those described above with respect to various other embodiments of the invention (particularly the embodiment of FIG. 1), a second shape memory element 231 in the form of a bowed wire which is rotatably mounted to an opposing side of pliable container 227, and a third closure element 232 that is also illustrated to constitute a band. Actually, in this embodiment, third closure element 232 either constitutes a passive, reinforcing element or a weak shape memory element since element 232 is adapted to conform to the shape of shape memory element 230 upon closing of pliable container 227. Therefore, the inner surface of element 232 that is attached directly to the side wall of pliable container 227 must assume a convex configuration upon closing of pliable container 227 since shape memory element is outwardly bowed. Regardless of the existence of any closure biasing by element 232, when pliable container 227 is open in the manner depicted in this figure, shape memory element 231 tends to bias pliable container 227 open to a degree greater than any tendency of closure element 232 to close the container.

As with the embodiment described above with respect to FIG. 7, the rotatable wire of shape memory element 231 will rotate upon the drawing of the side walls of pliable container 227 together. Therefore, when pliable container 227 is closed, shape memory elements 230 and 232 will be nested and shape memory element 231 will actually be tucked slightly under shape memory element 230. This configuration has been found to provide an enhanced seal for pliable container 227 since all of the shape memory elements 230–232 are tending to maintain the pliable container 227 in the sealed condition. In addition, with shape memory element 231 becoming slightly tucked under shape memory element 230, even when pliable container 227 is turned upside-down, items placed in the pliable container 227 cannot easily wedge between shape memory elements 230 and 231. This wedging action would be required if the contents of pliable container 227 were to open the container.

Although the wire of shape memory element 231 can be mounted in various fashions to pliable container 227 in accordance with the present invention, including above element 232, inside container 227 and sandwiched between element 232 and container 227, shape memory element 231 is shown to be encapsulated within a wrapping 238 that includes a mounting section 240. Preferably, mounting section 240 is heat sealed or otherwise fixedly mounted between a respective side wall of pliable container 227 and shape memory element 232. This mounting arrangement enables shape memory element 231 to be applied to a container 227 having only a single ply while still enabling the wire to be completely encapsulated.

Figure 9:
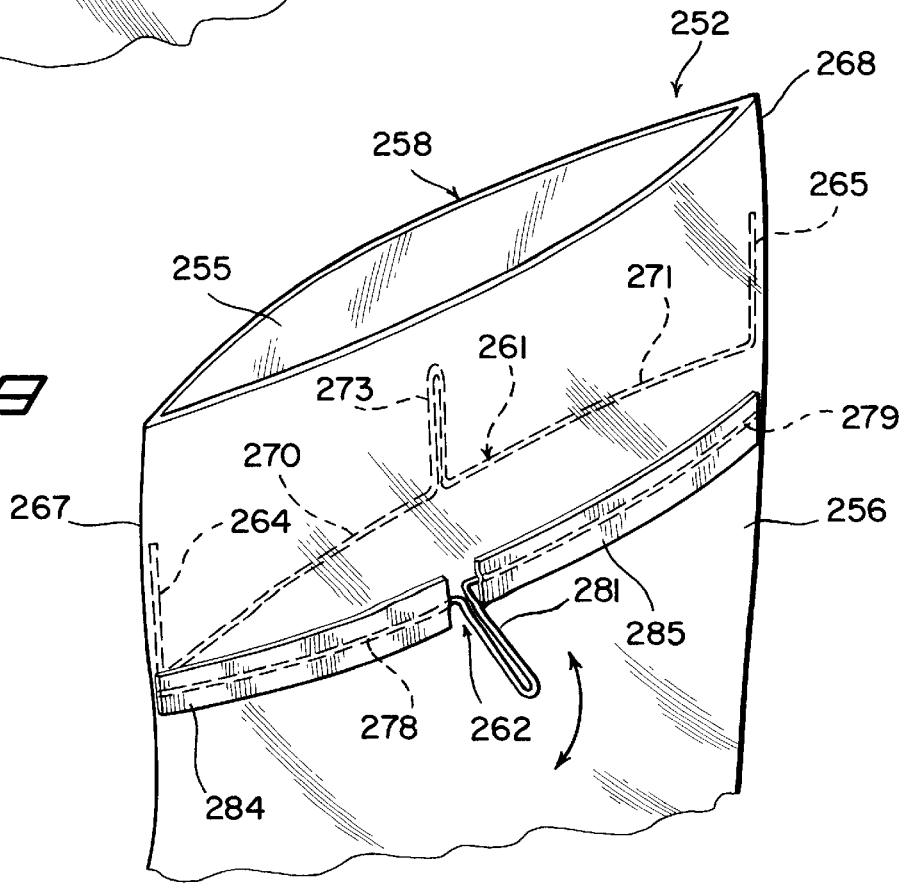
FIG. 9 is a partial perspective view of a pliable container incorporating a closure system constructed in accordance with a seventh embodiment of the invention.

FIG. 9 illustrates a still further rotatable shape memory element embodiment constructed in accordance with the present invention. This embodiment is shown illustrated on a pliable container 252 having side walls 255 and 256 and an openable end 258. Attached to side wall 255 is a first shape memory element 261 and rotatably mounted to side wall 256 is a second shape memory element 262. As with the other embodiments disclosed, each of these shape memory elements includes respective concave and convex surface portions. Since first shape memory element 261 is fixed to side wall 255, the element is always bowed outward. However, in accordance with this embodiment, first shape memory element 261 constitutes a wire that includes upstanding portions 264 and 265 arranged directly adjacent side edges 267 and 268 of side wall 255, a pair of tranversely extending portions 270 and 271 and a central upstanding portion 273. Although first shape memory element 261 can be made from various wire sections, it is preferably constituted by a single wire that is bent to form upstanding portions 264 and 265, as well as central upstanding portion 273. With this arrangement, upstanding portions 264, 265 and 273 prevent rotation of first shape memory element 261 about an axis defined by transversely extending portions 270 and 271, while also exhibiting torsion and stiffness enhancing characteristics.

On the other hand, second shape memory element 262 includes a pair of transverse portions 278 and 279 that are interconnected by a central handle portion 281. Mounting transverse portions 278 and 279 to side wall 256 are a pair of transversely spaced, laminating strips 284 and 285. The strips 284 and 285 secure transverse portions 278 and 279 to side wall 256 while permitting rotation of transverse portions 278 and 279 about their associated arcuate, longitudinal axis.

With this arrangement, when central handle member 281 is rotated in one direction, say downward as viewed in this figure, to a position substantially overlying side wall 256, the concave surfaces of transverse portions 278, 279 will be arranged away from side wall 256, thereby causing pliable container 252 to remain open in order to enhance the accessibility of items placed therein. Conversely, when central handle portion 281 is rotated upwardly, side wall 256 will be drawn towards side wall 255 and second shape memory element 262 will become nested with first shape memory element 261.

With respect to this embodiment, it should be noted that first shape memory element 261 not only tends to open pliable container 252 through the use of bending forces, but the presence of upstanding portion 273 functions to develop torsional forces that further enhance the opening of the pliable container. Therefore, such an arrangement provides a fair amount of spring action when it is desired to open pliable container 252. Due to this fact, the transverse portions 270, 271, 278 and 279 of shape memory elements 261 and 262 could actually be straight, but angled with respect to one another to cause side walls 255 and 256 to assume a generally diamond-shaped configuration when opened and a generally V-shape in top view when closed. However, the bowing of shape memory elements 261 and 262 is preferred. Of course, the bending and torsional forces created by first shape memory element 261 do not counteract the forces used to maintain the pliable container 252 in a closed condition upon rotation of central handle member 281. In addition, as with the embodiment of FIG. 7, second shape memory element 262 will actually tend to rotate on its own when side walls 255 and 256 are drawn together and therefore central handle member 281 is not a required element. In the alternative, central handle member 281 could actually have a separate gripping element (not shown) attached thereto for conveniently grasping and shifting handle member 281.

It should be realized that the closure system of the present invention can actually be applied to various types of containers, including paper and plastic bags. Therefore, although the closure system of the present invention has been depicted for use in each of the above-described embodiments on pliable containers having only a pair of spaced, generally vertically extending side edges or seams, it should be readily understood that the invention can also be applied to various types of containers including gusseted bags, such as typical grocery shopping bags or coffee bags which have two main side panels and two pairs of folding side panels or infolds. Reference will now be made to FIGS. 10–13 in describing a few preferred embodiments wherein the closure system of the present invention is incorporated in gusseted bags.

Figure 10:
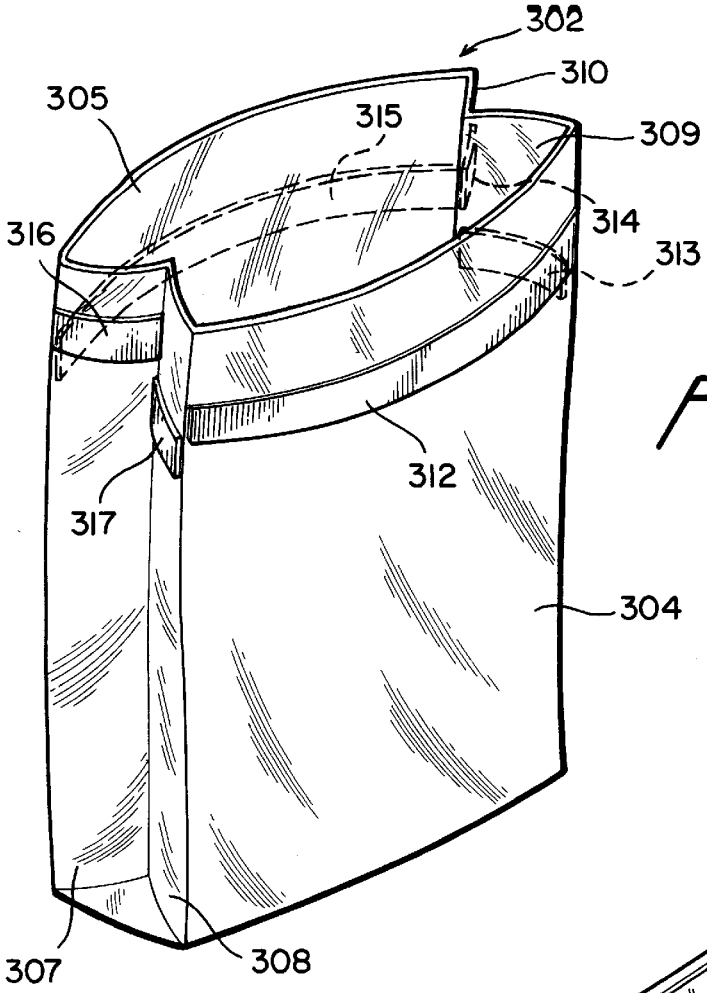
FIG. 10 is a partial perspective view of a pliable container incorporating a closure system constructed in accordance with a eighth embodiment of the invention, with the closure system shown in an open condition.
Figure 11:
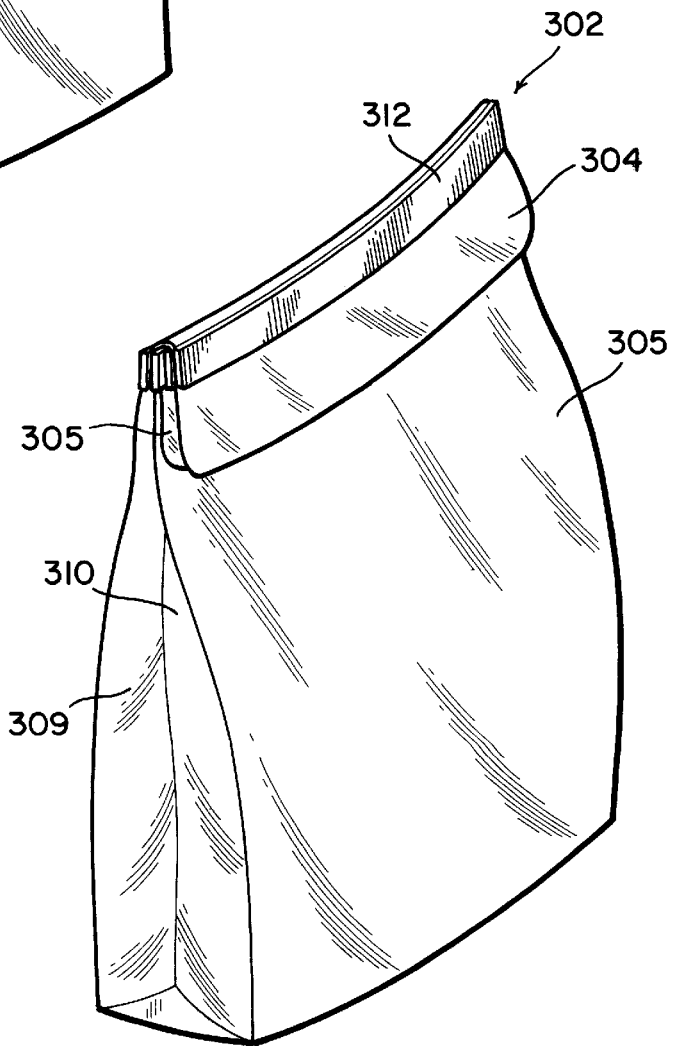
FIG. 11 is a partial perspective view of an upper portion of the pliable container shown in FIG. 10 in a closed condition.

FIGS. 10 and 11 depict a gusseted bag 302 having a pair of main side panels 304 and 305 and multiple folding side panels 307–310. Attached to each of the side panels 304, 305 and 307–310 is a respective, shape memory element 312–317. At least shape memory elements 312 and 315, but preferably each shape memory element 312–317, are bowed so as to include respective concave and convex surface portions. What is important to note in this embodiment is the fact that the shape memory elements 312–317 alternate between upper and lower vertical positions as they extend around gusseted bag 302. With this arrangement, the drawing of main side panels 304 and 305 together will cause the closure system of the present invention to assume the position as shown in FIG. 11.

Figure 12:
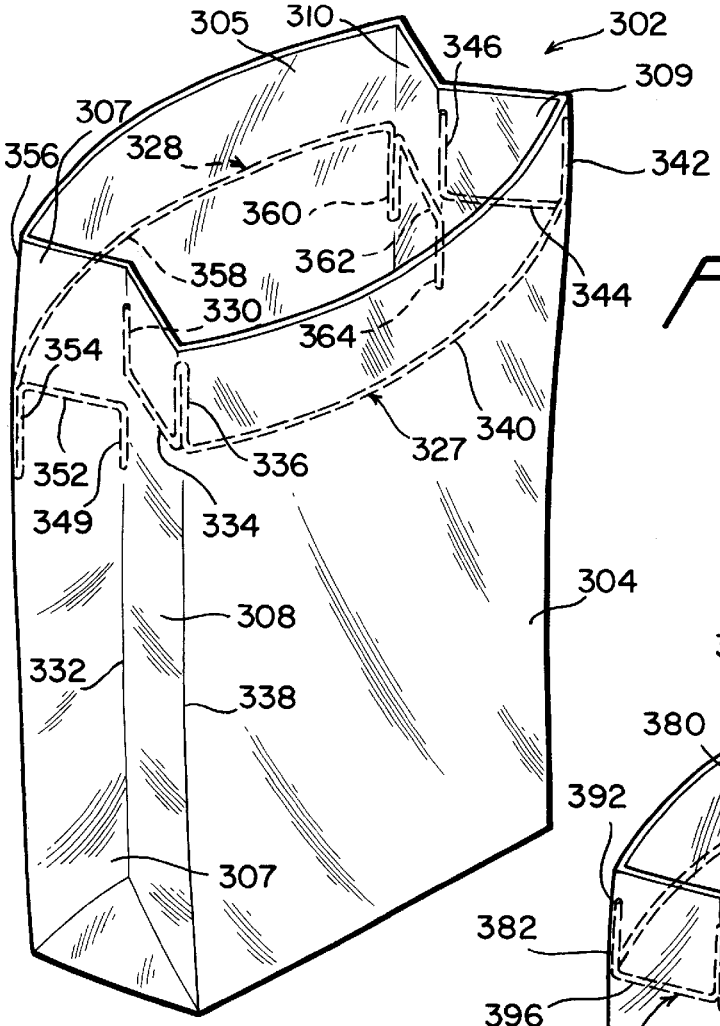
FIG. 12 is a partial perspective view of a pliable container incorporating a closure system constructed in accordance with a ninth embodiment of the invention, with the closure system shown in an open condition.
Figure 13:
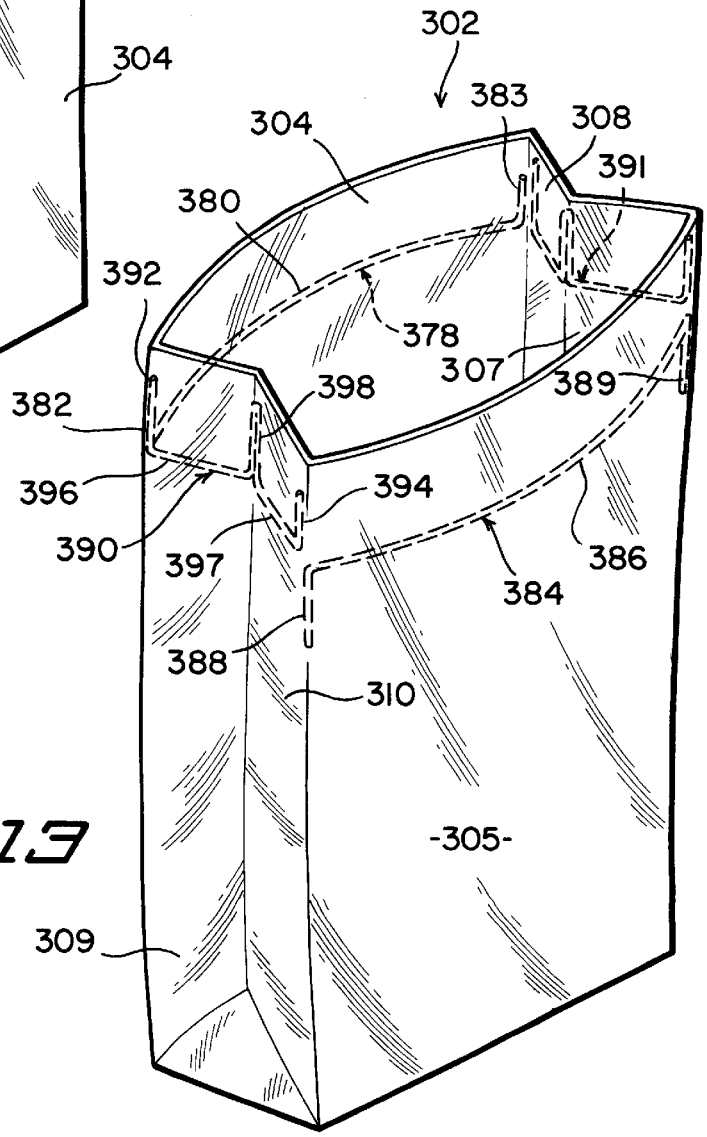
FIG. 13 is a partial perspective view of a pliable container incorporating a closure system constructed in accordance with a tenth embodiment of the invention, with the closure system shown in an open condition.

Since the embodiments of FIGS. 12 and 13 illustrate the closure system of the present invention applied to an identical type of gusseted bag 302 as that shown and described with respect to FIG. 10, the same reference numerals have been brought forward to these figures to identify corresponding parts. The embodiment of FIG. 12 differs in that wire shape memory elements 327 and 328 are utilized. More specifically, shape memory element 327 includes an upstanding portion 330 that is affixed to gusseted bag 302 directly adjacent a fold line 332 arranged between folding side panels 307 and 308, a generally horizontal portion 334 that extends along folding side panel 308, an upstanding section 336 that extends on either side of a fold line 338 between folding side panel 308 and main side panel 304, a main transverse portion 340 extending across main panel 304, an upstanding section 342 making the transition between main side panel 304 and folding side panel 309, a horizontal portion 344 extending along folding side panel 309 and an upstanding portion 346 positioned between folding side panels 309 and 310. Shape memory element 328 is essentially inversely arranged to shape memory element 327 and includes a down-turned portion 349, a first generally horizontal portion 352, a downwardly extending section 354 that extends about a fold line 356 between folding side panel 307 and main side panel 305, a main transverse section 358, a downwardly extending section 360, a generally horizontal portion 362 and a down-turned portion 364.

As with the embodiment of FIG. 9, the use of upstanding and down-turned portions 336, 342, 354 and 360 in shape memory elements 327 and 328 additionally provide torsional forces which enhance the automatic opening of gusseted bag 302. In fact, in the embodiment depicted, horizontal portions 334, 344, 352 and 362 are preferably constituted by straight sections of wires to better conform to the shape of folding side panels 307–310 respectively. However, given their construction, the torsional forces developed adequately aid in maintaining bag 302 open. Due to this arrangement, the developed forces tending to maintain bag 302 closed is made greater than these torsional forces. In other words, the bending forces associated with main transverse sections 340 and 358 are made to greatly counteract the combined torsional forces tending to open bag 302 such that bag 302 can be adequately sealed when desired.

The embodiment of FIG. 13 is substantially identical to that of FIG. 12 except that four wire shaped memory elements are utilized. The first shape memory element 378 is provided with a transverse portion 380 and a pair of up-turned end portions 382 and 383; the second, opposing shape memory element 384 is provided with a transverse portion 386 and down-turned end portions 388 and 389; and side shape memory elements 390 and 391 are each provided with upstanding end members 392 and 394, horizontal end portions 396 and 397, and an upstanding central member 398 formed from a bent portion of a respective shape memory element 390 and 391. Again, the presence of the upstanding central members 398 in this embodiment function to develop torsional forces with further aid in opening the gusseted bag, along with the bending forces developed by the bowed shape memory elements 378 and 384. Also, as with the embodiments of FIGS. 10–12, the embodiment of FIG. 13 provides for sealing of the gusseted bag by a folding over of the top portion of the bag such that shape memory element 384 nests with shape memory element 378. With respect to the embodiments of Figures of 12 and 13, it should again be understood that the horizontal portions 396 and 397 extending along folding side panels 307–310 need not be bent but could simply be constituted by straight wire portions. The torsional forces developed due to the presence of the upstanding central member 398 provide for an adequate propping open of the gusseted bag 302 as desired.

Figure 14:
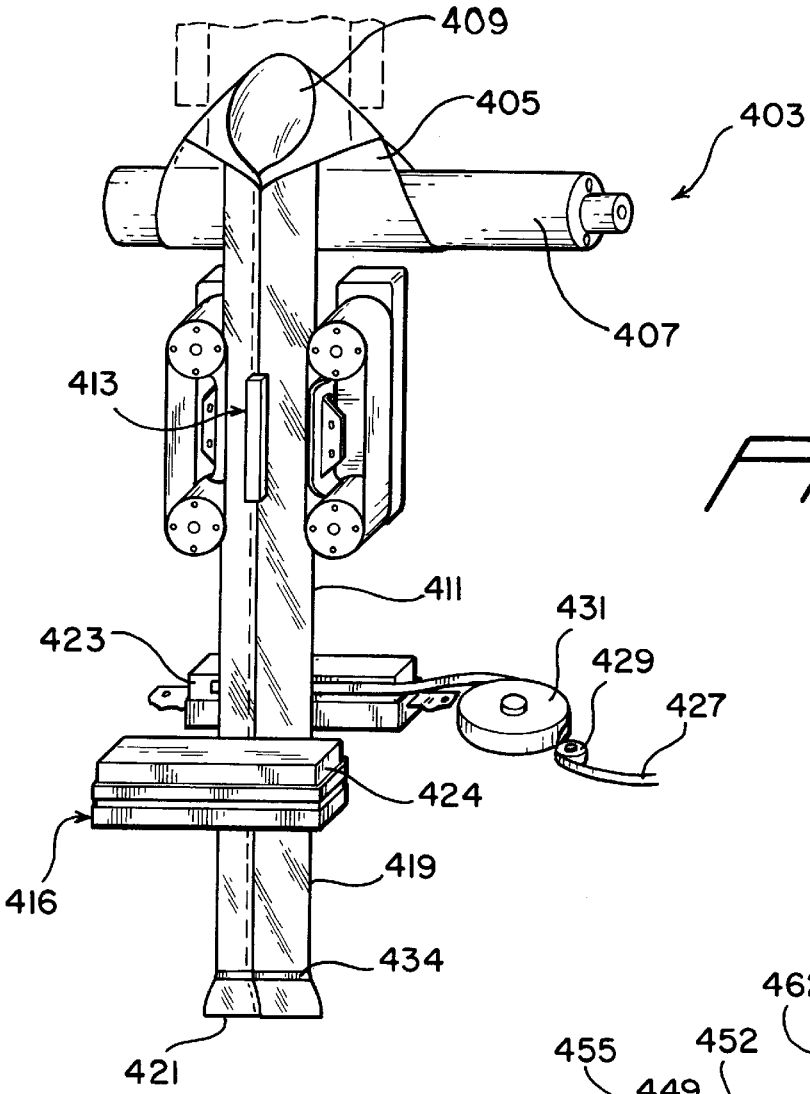
FIG. 14 illustrates a vertical form, fill and seal apparatus adapted for continuously making pliable containers incorporating the closure system of the present invention.

As mentioned above, the shape memory elements incorporated in the closure system of the present invention can be either integrally formed with the pliable containers or simply attached thereto. When integrated into the manufacture of a pliable container, the shape memory elements can be again applied to either the inside or outside of the pliable containers. When utilizing a known type of vertical form, fill and seal machine, application of the shape memory elements to an outside surface of the pliable bag is preferably performed prior to filling of the bag such that any contents placed in the bag will not hamper the attachment of the shape memory elements. With reference to FIG. 14, a section of a vertical form, fill and seal machine is generally indicated at 403. As is known in the art, machine 403 will receive a web 405 that extends about a roller 407 and is inverted about a mandrel 409. The mandrel 409 shapes the web 405 into an elongated tubular member 411 following application of a longitudinal seam sealer 413. A lower heat sealer/bag cutter unit 416 simultaneously creates a lower end seal for a first pliable container 419 and an upper seal for the next pliable container, while cutting the pliable container 419 from the remainder of the tubular member 411. Actually, the tubular member 411 is shown inverted such that the lower end of pliable container 419 actually constitutes the top thereof which defines the openable end 421 in accordance with the present invention.

Again, this structure of vertical form, fill and seal machine 403 is known in the art and not considered part of the present invention. However, in accordance with the present invention, the heat sealer/bag cutter 416 has mounted thereon upper shape memory element applicators 423 and 424, each of which receives a band 427 or other type of shape memory element as described above that is delivered over a guide roller 429 and a shaping wheel 431. Upper shape memory applicators 423 and 424 would also include cutters (not shown) for the bands 427. In any event, a respective shaping wheel 431 can be effectively utilized to give each band 427 its relaxed, bowed shape such that band 427 is delivered to the applicator 423 or 424 with the desired concave and convex surfaces. Although not shown in this figure for simplicity of the drawings, a similar arrangement would be provided to supply a shape memory element to applicator 424. With this arrangement, when heat sealer/bag cutter 416 is drawn against tubular member 411, applicators 423 and 424 will heat sealingly apply respective shape memory elements, such as that indicated at 434, adjacent the openable end 421 of each pliable container 419, to each pliable container in succession.

In embodiments where various shape memory elements are []arranged in spaced planes, the applicator bars would typically extend a distance twice as high as the shape memory elements to accommodate for the offset vertical positioning thereof. If applied internally on the bag, inner and outer applicator bars would be utilized to apply each shape memory element. In addition, for gusseted bags, further applicators would be utilized for applying the shape memory elements on the infolds. To apply shape memory elements to an inside surface of a pliable container on a typical form, fill and seal machine, methods that have been utilized in the past to apply zip-type fasteners could also be readily employed. For example, the shape memory elements could be inserted as a pair through an edge fin seal or a separate, temporary slit with the aid of a retractable probe or could simply be applied vertically just inside the fin seal.

Figure 15:
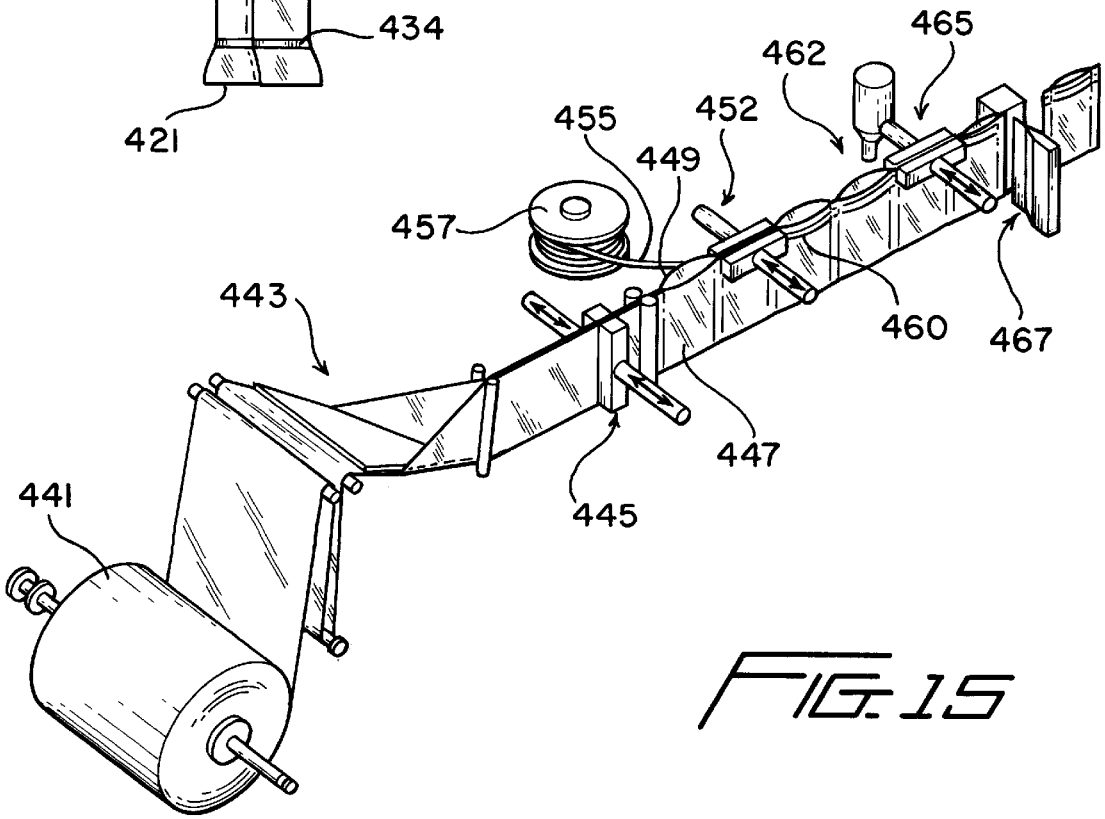
FIG. 15 illustrates a horizontal form, fill and seal apparatus adapted for continuously making pliable containers incorporating the closure system of the present invention.

Similar results can be achieved utilizing horizontal form, fill and seal machines such as that indicated in FIG. 15. In this arrangement, a web supply 441 runs through a folding stage 443 and then to a vertical sealer 445. Since the web is folded over onto itself and vertical sealer 445 creates side seals, a pliable container 447 with a single open end 449 is formed. Next, the pliable container is delivered to a shape memory element applicator stage generally indicated at 452 wherein bands or other types of shape memory elements 455 are delivered to opposing sides of the pliable container 447 from spools, one of which is indicated at 457. Following applicator stage 452, pliable container will have attached thereto desired shape memory elements, one of which is indicated at 460. Next, the pliable container will be delivered to a filling stage 462, an upper end sealing stage 465 and a cutting stage 467. By providing applicator stage 452 prior to filling stage 462, the shape memory elements can be properly positioned on the sides of pliable container 447 to assure proper nesting thereof during later use when the closure formed by upper end sealer 465 is torn open to access the contents placed within pliable container 447 and the closure system of the present invention is used to repetitively open and sealingly close the pliable container.

Again, although various types of sealing arrangements can be utilized as indicated above, heat sealing is considered to be the most economical and feasible application method and enables the shape memory elements to be applied to the pliable container before the pliable container is fully formed. In addition, the shape memory elements themselves can be formed as separate elements and attached to the pliable containers as indicated above, or the shape memory elements, whether formed as plastic bands, wires or otherwise, could be integrated with the web that is fed to the form, fill and seal machines. Therefore, the shape memory elements could be incorporated in the supply rolls and then unwound commensurate with the web. In addition, the shape memory elements could be formed as separate supply rolls, either taking the form of a narrow strip which is then cut into individual spring members end-to-end or a wide strip which is cut into individual spring members side-to-side. Furthermore, the shape memory elements could be formed from the bag material itself, such as by accordion pleating, folding or rolling up sections of the bag material and then flattening the same through a heat sealing operation. Of course, it should be readily recognized that the shape memory elements in accordance with the present invention could also be separately packaged and sold to be directly applied to pliable containers by the consumer, such as by utilizing a double-sided tape or an adhesive layer with a release strip provided on each shape memory element.

As clearly exemplified by the embodiments described above, the shape memory elements of the closure system of the present invention may take various forms, including bands and wires. It should also be noted that the shape memory elements can have constant or varying widths and cross-sectional configurations, regardless of whether they are formed integral with the pliable containers or separately therefrom. What is important is the provision for opposing shape memory elements to be complementary in shape when the pliable container is placed in a closed condition to assure adequately sealing thereof. Furthermore, provisions can be incorporated to enhance the sealing of the pliable container, such as incorporating a compliant strip of material inside the container at the fold line to act as a running gasket to ensure air tightness. If desired, additional fasteners, e.g. snaps, hook and loop or zip-type connectors, can be added if it is desired to more securely maintain the pliable container in a closed condition. Such additional fasteners can be particularly advantageously applied to the embodiments shown in FIGS. 4 and 7 since the closure systems therein tends to more easily opened when pressurized from within, such as occurs when inverting a bag having a heavy content.

In any event, from the above description of preferred embodiments of the invention, it should be readily apparent that various changes and/or modifications can be made without departing from the spirit of the invention. For instance, the closure system is not limited for use with a container which is entirely pliable, but rather one in which only the opening/sealing portion of the container is pliable. Also, the container need not have one end which is always closed. Instead, the invention could be applied to a sleeve-like container which itself is slipped into or otherwise secured to another bag as an insert. In addition, it should be realized that the various shape memory elements could range in size and shape in accordance with the invention. Furthermore, when referring to various directions in the description provided, such as the vertical direction, it should be readily understood that reference was only being made to the arrangement of the containers depicted in the drawings. Therefore, such directions are relative and not intended to be specifically limiting. Instead, the invention is only intended to be limited by the scope of the following claims.

What is claimed:

1. A closure system on a pliable container for use in repetitively opening and sealingly closing an openable end of the pliable container comprising: first and second shape memory elements each of which assumes a bowed shape in a relaxed state so as to define an elongated, generally concave surface portion and an opposing, generally convex surface portion, the first and second shape memory elements being attached to respective opposing side walls of the pliable container adjacent the openable end and interconnected solely through the pliable container, with the generally concave surface portions of the first and second shaped memory elements facing each other when the pliable container is in an open condition to maintain the opposing side walls in a spaced relationship to permit ready access to an interior of the pliable container and with the generally concave surface portion of the first shape memory element nesting with the generally convex surface portion of the second shape memory element when the pliable container is in a closed condition to maintain the side walls in a close bearing relationship at the openable end.

2. A closure system on a pliable container for use in repetitively opening and seemingly closing an openable end of the pliable container comprising: first and second shape memory elements each of which assumes a bowed shape in a relaxed state so as to define an elongated, generally concave surface portion and an opposing, generally convex surface portion, the first and second shape memory elements being attached to respective opposing side walls of the pliable container adjacent the openable end, at the generally concave surface portions of the first and second shaped memory elements facing each other when the pliable container is in an open condition to maintain the opposing side walls in a spaced relationship to permit ready access to an interior of the pliable container and with the generally concave surface portion of the first shape memory element nesting with the generally convex surface portion of the second shape memory element when the pliable container is in a closed condition to maintain the side walls in a close bearing relationship at the openable end, wherein the first shape memory element is located closer to the openable end than the second shape memory element when the pliable container assumes the open condition and wherein the first shape memory element overlies the second shape memory element in a common plane when the pliable container assumes the closed condition by folding over the pliable container portion to which the first shape memory element is attached.

3. The closure system according to claim 2, wherein each of the first and second shape memory elements extends across substantially an entire transverse width of the pliable container.

4. The closure system according to claim 3, wherein at least one of the first and second shaped memory elements is constituted by an elongated, plastic band.

5. The closure system according to claim 4, further comprising at least one reinforcing member attached transversely across one of the opposing side walls at the openable end of the pliable container and below the first shape memory element.

6. A closure system on a pliable container for use in repetitively opening and sealingly closing an openable end of the pliable container comprising:

first and second shape memory elements each of which assumes a bowed shape in a relaxed state so as to define an elongated, generally concave surface portion and an opposing, generally convex surface portion, the first and second shape memory elements being attached to respective opposing side walls of the pliable container adjacent the openable end, with the generally concave surface portions of the first and second shaped memory elements facing each other when the pliable container is in an open condition to maintain the opposing side walls in a spaced relationship to permit ready access to an interior of the pliable container and with the generally concave surface portion of the first shape memory element nesting with the generally convex surface portion of the second shape memory element when the pliable container is in a closed condition to maintain the side walls in a close bearing relationship at the openable end; and third and fourth shape memory elements which are mounted, in conjunction with the first and second shape memory elements, alternately above and below one another around the opposing side walls of the pliable container.

7. The closure system according to claim 6, wherein the pliable container is constituted by a gusseted bag, with the opposing side walls constituting main sides of the gusseted bag and the gusseted bag further including four interconnected folding side panels, said closure system including a shape memory element attached to each of the side panels of the gusseted bag.

8. The closure system according to claim 7, wherein each of the shape memory elements is constituted by wire.

9. The closure system according to claim 7, wherein each of the first and second shape memory elements extends across one of the main panels of the gusseted bag, as well as across at least one of the folding side panels.

10. The closure system according to claim 1, wherein each of the first and second shaped memory elements is be secured to an exterior surface portion of the pliable container.

11. The closure system according to claim 10, wherein each of the first and second shape memory elements is adhesively secured to the interior surface portion of the pliable container.

12. The closure system according to claim 1, wherein at least one of the first and second shape memory elements is constituted by a wire.

13. The closure system according to claim 12, wherein the wire is sandwiched between two laminating sheets prior to attachment to the pliable container.

14. The closure system according to claim 1, wherein the closure system is utilized on a pliable container having side walls each of which is formed from multiple layers with at least one of the first and second shape memory elements being mounted between the multiple layers of a respective one of the side walls.

15. The closure system according to claim 1, wherein at least one of the first and second shape memory elements has an associated longitudinal axis and is mounted to one of the side walls of the pliable container for rotation about the longitudinal axis.

16. The closure system according to claim 15, wherein the first and second shaped memory elements are located directly opposite one another, in a common plane, when the pliable container assumes either of the open or closed conditions.

17. The closure system according to claim 15, wherein the at least one of the first and second shape memory elements defines a handle portion that projects at an angle to the arcuate longitudinal axis, with the handle portion being adapted to be manually grasped to rotate the at least one of the first and second shape memory elements about the arcuate longitudinal axis.

18. The closure system according to claim 15, wherein said at least one of the first and second shape memory elements is constituted by a spring wire.

19. The closure system according to claim 18, further comprising an additional closure element extending transversely across the pliable container on the same side wall as the spring wire.

20. A closure system on a pliable container having an associated transverse width defined by a pair of opposing side walls and an openable end that can be placed in an open condition to permit access to an interior of the container and a closed condition comprising: first and second shape memory elements each of which has an associated length substantially equal to the transverse width of the pliable container and an associated width that extends in a longitudinal direction of the container, each of the first and second shape memory elements assuming a bowed shape in a relaxed state so as to define an elongated, generally concave surface portion and an opposing, generally convex surface portion, the first shape memory element being attached to and extending across substantially the entire transverse width of one of the opposing side walls at a first position and the second shape memory element being attached to and extending across substantially the entire transverse width of one of the opposing side walls at a second position, wherein the first shape memory element is offset from and located closer to the openable end of the container than the second shape memory element when the container is in the open condition and the first shape memory element overlaps the second shape memory element to maintain the side walls in a close bearing relationship at the openable end when the pliable container is in the closed condition.

21. The closure system according to claim 20, wherein the first and second shape memory elements are mounted on respective ones of the opposing side walls such that, in the open condition, the first and second shape memory elements maintain the opposing side walls of the pliable container in a spaced relationship to permit ready access to the interior of the pliable container.

22. The closure system according to claim 21, wherein at least one of the first and second shape memory elements comprises a rotatable wire.

23. The closure system according to claim 22, wherein the rotatable wire defines an associated longitudinal axis and includes a handle portion which extends at an angle to the longitudinal axis.

24. The closure system according to claim 21, wherein at least one of the first and second shape memory elements includes terminal legs that extend substantially perpendicular to the length of the at least one of the first and second shape memory elements at positions directly adjacent side edges of the pliable container.

25. The closure system according to claim 21, wherein the pliable container defines a gusseted bag having a pair of opposing main side panels and four interconnected folding side panels, with the first and second shape memory elements being attached to the main side panels and the closure system further includes additional closure elements attached to each of the folding side panels.

26. The closure system according to claim 25, wherein the additional closure elements define torsion elements which bias the gusseted bag into the open condition.

27. The closure system according to claim 25, wherein at least one of the additional elements is formed integral with a respective one of the first and second shape memory elements.

28. The closure system according to claim 20, wherein each of the first and second shape memory elements is attached to an identical one of the opposing side walls.

29. The closure system according to claim 28, wherein at least one of the first and second shape memory elements is constituted by a wire.

30. The closure system according to claim 29, wherein the wire zig-zags transversely across the pliable container.

31. A method of providing a pliable container with a repetitively opening and sealingly closing openable end comprising: attaching separate and distinct first and second shape memory elements, each of which includes an elongated, generally concave surface portion and an opposing, generally convex surface portion, to respective opposing side walls of the pliable container adjacent the openable end, while arranging the generally concave surface portions of the first and second shape memory elements facing each other when the pliable container is in an opened condition to maintain the opposing side walls in a spaced relationship to permit ready access to an interior of the pliable container, and nesting the concave surface portion of the first shape memory element with the convex surface portion of the second shape memory element when the pliable container assumes a closed condition to maintain the side walls in a close bearing relationship at the openable end.

32. The method according to claim 31, further comprising: causing the first shape memory element to fold over to cause the concave surface portion thereof to nest with the convex surface portion of the second shape memory element when the pliable container is placed in the closed condition.

33. A method of providing a pliable container with a repetitively opening and sealingly closing openable end comprising: positioning first and second shape memory elements, each of which includes an elongated, generally concave surface portion and an opposing, generally convex surface portion, at vary heights on respective opposing side walls of the pliable container adjacent the openable end, while arranging the generally concave surface portions of the first and second shape memory elements facing each other when the pliable container is in an opened condition to maintain the opposing side walls in a spaced relationship to permit ready access to an interior of the pliable container, and nesting the concave surface portion of the first shape memory element with the convex surface portion of the second shape memory element when the pliable container assumes a closed condition to maintain the side walls in a close bearing relationship at the openable end.

34. The method according to claim 31, further comprising: attaching first and second reinforcing elements to the side walls of the pliable container below and above the first and second shape memory elements respectively.

35. The method according to claim 31, further comprising: forming at least one of the first and second shape memory elements from a bowed wire and sandwiching the wire between a pair of laminating sheets.

36. The method according to claim 31, further comprising: forming one of the first and second shape memory elements from a bowed wire; mounting the first and second shape memory elements directly opposite one another at a commensurate level along the opposing side walls of the pliable container; and rotating the bowed wire when the openable end is shifted between the open and closed conditions.

37. In a method of producing pliable containers through a form, fill and seal machine wherein a web of material is shaped into a tubular member which is sealed at a first end, filled and then sealed at a second, opposing end, the improvement comprising: attaching a repetitively usable closure system including at least two separate and distinct shape memory elements, each of which assumes a bowed shape in a relaxed state so as to define an elongated, generally concave surface portion and an opposing, generally convex surface portion, transversely across and adjacent one of the first and second ends of the tubular member prior to filling of the tubular member.

38. The method according to claim 37, further comprising: attaching the shape memory elements to opposing side walls of the pliable container.

39. The method according to claim 37, further comprising: attaching one of the shape memory elements closer to the at least one of the first and second ends of the tubular member than the other of the shape memory elements.

40. The method according to claim 37, further comprising: rotatably attaching at least one of the shape memory elements to the tubular member.

41. A method of producing a pliable container incorporating a closure system that enables side walls of the container to be repetitively spaced apart in order to access an interior of the pliable container through an openable end and selectively maintained in a close bearing relationship to effectively seal the openable end comprising:

advancing a supply of pliable material;

working the pliable material to form a container having at least one openable end leading into the interior of the container;

attaching at least two separate and distinct shape member elements each of which assumes a bowed shape in a relaxed state to as to define an elongated, generally concave surface portion and an opposing, generally convex surface portion, transversely across at least one of the side walls of the container, adjacent the openable end;

filling the interior of the pliable container; and closing the openable end of the container.

42. The method according to claim 41, further comprising: attaching the shape memory elements to opposing side walls of the pliable container.

43. The method according to claim 41, further comprising: attaching one of the shape memory elements closer to the at least one of the first and second ends of the tubular member than the other of the shape memory elements.

44. The method according to claim 41, further comprising: rotatably attaching at least one of the shape memory elements to the container.

* * * * *